US006021298A

United States Patent [19]

Liu et al.

[11] Patent Number: 6,021,298

[45] Date of Patent: Feb. 1, 2000

[54] EMBEDDED DOCTOR BLADE ARRANGEMENT

[75] Inventors: Dean Liu, West Hills, Calif.; Lun Chang, Hsinchu, Taiwan

[73] Assignee: Aetas Technology Corp., Irvine, Calif.

[21] Appl. No.: 09/237,764

[22] Filed: Jan. 26, 1999

[51] Int. Cl.[7] ..... G03G 15/08

[52] U.S. Cl. ..... 399/284

[58] Field of Search ..... 399/284, 274, 399/350, 351, 107, 110, 264

[56] References Cited

U.S. PATENT DOCUMENTS

| | | | |
|---|---|---|---|
| 4,561,766 | 12/1985 | Fox | 399/102 |
| 4,585,328 | 4/1986 | Moser et al. | 118/261 |
| 4,742,797 | 5/1988 | Barker | 399/264 X |
| 4,990,959 | 2/1991 | Yamamuro et al. | 399/274 |
| 5,006,898 | 4/1991 | Kobayashi et al. | 399/274 |
| 5,084,739 | 1/1992 | Kalyandurg et al. | 399/350 X |
| 5,303,010 | 4/1994 | Takano et al. | 399/126 |
| 5,338,895 | 8/1994 | Ikegawa et al. | 399/280 |
| 5,373,353 | 12/1994 | Fukasawa | 399/284 |
| 5,570,168 | 10/1996 | Koga et al. | 399/272 |
| 5,583,622 | 12/1996 | Nishimura | 399/274 |
| 5,602,631 | 2/1997 | Sakaguchi | 399/284 |
| 5,722,021 | 2/1998 | Iwao | 399/284 |
| 5,752,146 | 5/1998 | Sato | 399/284 |
| 5,805,966 | 9/1998 | Yamada | 399/284 |

*Primary Examiner*—Sandra Brase
*Assistant Examiner*—Sophia S. Chen
*Attorney, Agent, or Firm*—Baker & Botts, L.L.P.

[57] ABSTRACT

The doctor blade arrangement described in the specification includes a doctor blade made of resilient sheet material having a toner thickness control end lightly engaging a toner layer on the surface of a development roller to control the thickness of the toner layer and a mounting end which is bent to be resiliently received in a mounting groove of the electrophotographic apparatus in which doctor blade is used. In one embodiment the mounting end has parallel bends forming a U-shape leading to a projecting mounting lip which is engaged by a projecting hook portion at one edge of the mounting groove. In other embodiments the mounting lip extends toward or away from the plane of the toner thickness control end of the doctor blade.

9 Claims, 2 Drawing Sheets

EMBEDDED DOCTOR BLADE ARRANGEMENT

BACKGROUND OF THE INVENTION

This invention relates to doctor blade arrangements for controlling the thickness of a layer of toner on a toner conveying member such as a development roller in an electrophotographic apparatus.

In electrophotographic apparatus such as copiers and printers in which an electrostatic image is developed by conveying a layer of toner adjacent to a surface bearing the electrostatic image it is important to provide accurate and uniform control of the thickness of the toner layer on the conveying member. In certain prior art toner layer thickness control arrangements, a flexible doctor blade extending across the width of a toner conveying member such as a development roller lightly engages the surface of the development roller to control the thickness of the toner layer. Consequently, the doctor blade which engages the toner layer must be kept straight and flat. Otherwise the thickness of the toner layer on the development roller will be uneven, resulting in poor printing quality.

In some conventional developing arrangements a doctor blade is affixed to a mounting member either directly or through a mounting plate by several screws. This has the disadvantages of requiring one or more mounting plates and several screws for fastening the doctor blade on the mounting member and of causing distortion of the doctor blade by the application of screws.

One typical prior art doctor blade mounting arrangement is shown in the Takano et al. U.S. Pat. No. 5,303,010 in which a flexible doctor blade is mounted by clamping screws to a support plate having adjustment slots and the support plate is in turn mounted by screws to mounting members. The Kobayashi et al. U.S. Pat. No. 5,006,898 also discloses a flexible doctor blade affixed to a support member by screws and the Sakaguchi U.S. Pat. No. 5,602,631 discloses a toner leveling member affixed by screws to a mount while the Sato U.S. Pat. No. 5,752,146 shows a doctor blade clamped by a support blade which is affixed by screws to a mount.

SUMMARY OF THE INVENTION

Accordingly, it is an object of the present invention to provide a doctor blade arrangement which overcomes disadvantages of the prior art.

Another object of the invention is to provide a doctor blade arrangement in which a flexible doctor blade is securely mounted without requiring mounting plates and screws and which avoids the problem of stress unevenness generated by application of screws.

These and other objects of the invention are obtained by providing a doctor blade arrangement in which a doctor blade made of a resilient sheet material is bent at a mounting end into a configuration which can be received in a correspondingly shaped mounting groove having a hook portion for engaging a lip portion of the doctor blade to retain the doctor blade in position. Preferably, the mounting end of the doctor blade is bent along a plurality of parallel lines in such a way that the resilience of the doctor blade material causes the mounting end of the doctor blade to expand in the groove after it has passed the hook portion of the groove so that the doctor blade is captured in the groove.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
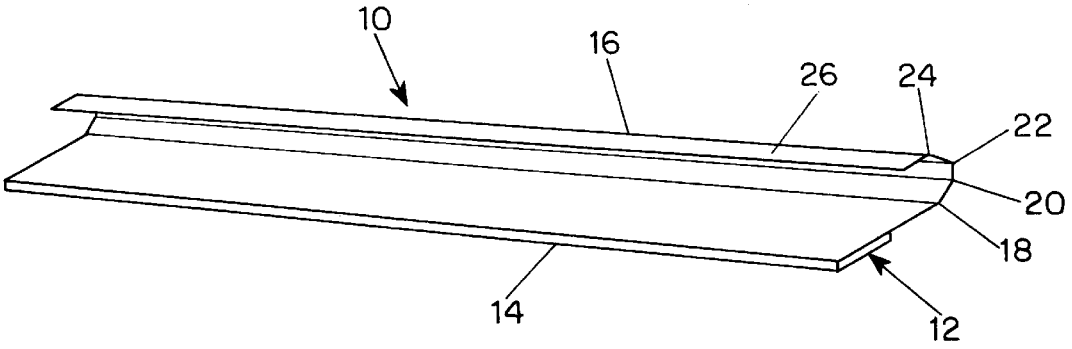
FIG. 1 is a perspective view showing a representative embodiment of a doctor blade arrangement according to the invention.
Figure 2:
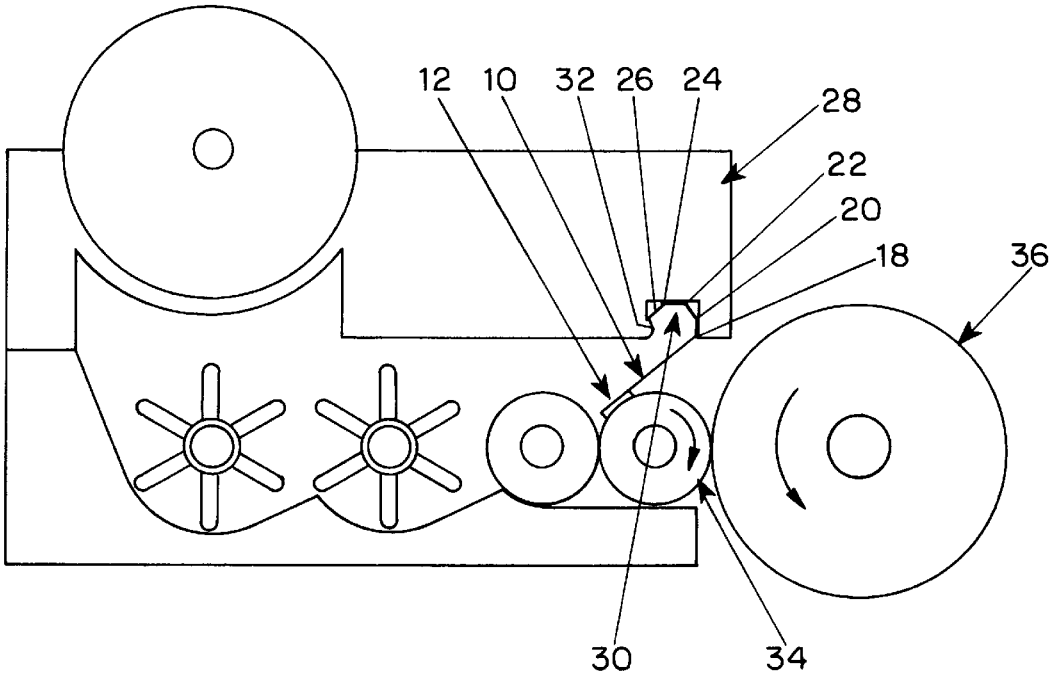
FIG. 2 is a schematic side view of an electrophotographic apparatus having a doctor blade arrangement with the structure shown in FIG. 1 mounted in a corresponding mounting groove.

In the typical embodiment of the invention shown in FIGS. 1 and 2, a doctor blade 10 is made from a thin sheet of resilient material, which may be a synthetic material or a thin metal such as stainless steel or phosphor bronze, having a toner thickness regulating end 12 with a toner engaging surface 14 and a mounting end 16. In the illustrated embodiment, the mounting end 16 is formed with four parallel bend lines 18, 20, 22 and 24 forming a 180° bend to provide a mounting lip 26 which extends substantially parallel to the plane of the toner thickness control end 12. The toner layer engaging surface 14 includes a region of enlarged thickness of the sheet material which provides longitudinal rigidity to the toner engaging end 12 for purposes of uniformity. Alternatively, a separate strip of material may be attached to the toner layer thickness control end of the sheet for that purpose.

FIG. 2 illustrates the mounting of the doctor blade shown in FIG. 1 in an otherwise conventional development unit 28 of an electrophotographic apparatus in accordance with the invention. The development unit 28 is provided with a mounting groove 30 conforming generally to the configuration of the mounting end 16 of the doctor blade 10 but including a projecting hook portion 32 arranged so that, when the mounting end 16 of the doctor blade is inserted into the groove 30, the mounting lip 26 is deflected during insertion and then resiliently restored so as to be caught behind the hook portion 32, thereby securely retaining the doctor blade in position in the groove as shown in FIG. 2.

When the doctor blade 10 is thus mounted in the groove 30 the toner thickness control surface 14 of the doctor blade lightly engages the surface of a development roller 34 by which toner is conveyed to a photoreceptor drum 36 so as to assure a uniform thickness of toner on the surface of the roller when it passes an adjacent surface of the photoreceptor drum.

With this structure a simple, inexpensive and convenient doctor blade mounting arrangement is provided which does not require screws or mounting plates and which assures uniformity of the pressure by which the toner engaging surface of the doctor blade engages the development roller, thereby avoiding the effects of nonuniform pressure resulting from mounting arrangements requiring screws and mounting plates.

Figure 3:
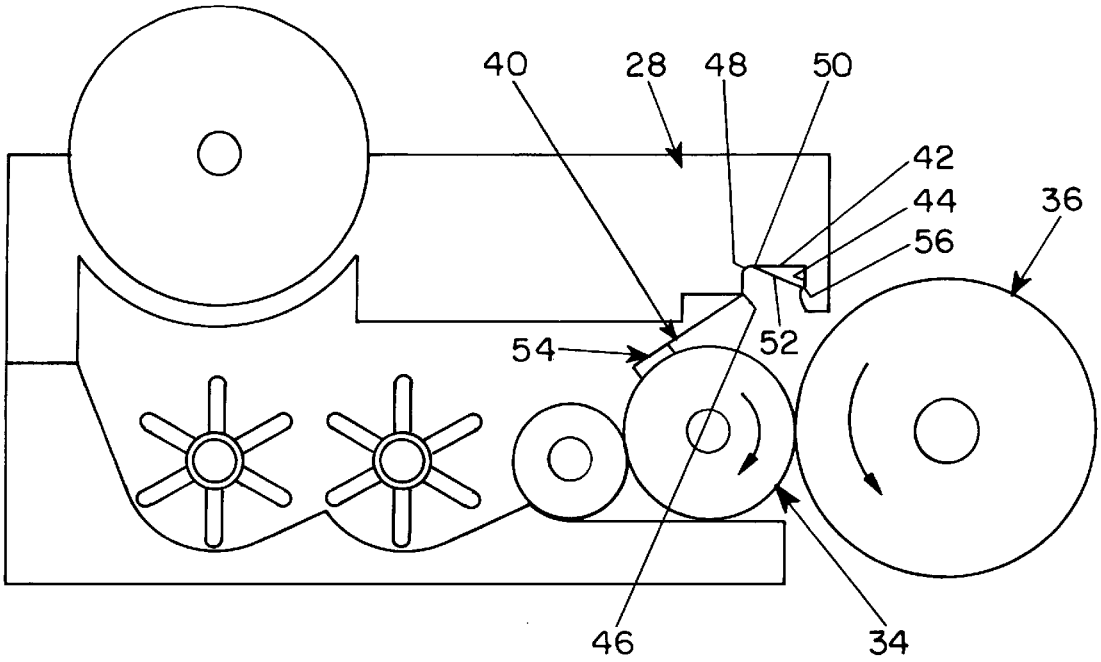
FIG. 3 is a schematic side view of an electrophotographic apparatus illustrating the mounting of another embodiment of a doctor blade arrangement according to the invention.

In the further embodiment of the invention illustrated in FIG. 3, a doctor blade 40 has a mounting end 42 which is inserted into a correspondingly shaped groove 44 of an electrophotographic apparatus development unit 28. In this embodiment three parallel bend lines 46, 48 and 50 are provided in the doctor blade mounting end 42 so that a mounting lip 52 extends at an approximately right angle away from the plane of the toner thickness control end 54 of the doctor blade. The groove 44 in the development unit 28 has a projecting hook portion 56 which captures the end of the mounting lip 52, thereby retaining the doctor blade securely in position in a simple and effective manner without requiring mounting screws or plates.

Figure 4:
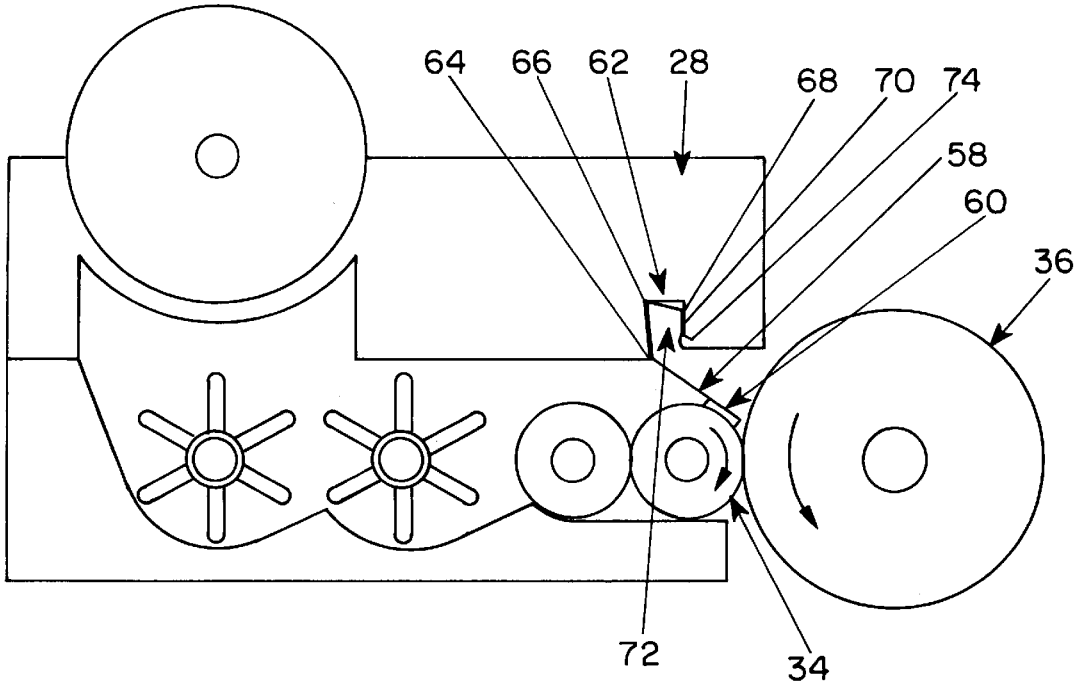
FIG. 4 is a schematic side view of an electrophotographic apparatus illustrating the mounting of another embodiment of a doctor blade arrangement in accordance with the invention.

In the additional embodiment of the invention shown in FIG. 4, a doctor blade 58 has a toner thickness control end 60 and a mounting end 62 formed with three bend lines 64, 66 and 68 leading to a mounting lip 70 which extends toward the plane of the toner thickness control end 60. The mounting end 62 is received in a mounting groove 72 in the development unit 28 having a projecting hook portion 74 which resiliently receives the mounting lip 70 to secure the doctor blade arrangement in a simple and effective manner. While the above-described doctor blade arrangements have three or four parallel bend lines in the mounting end, it should be apparent that the bent portion of the mounting end may be continuously curved or may have fewer or more bend lines as desired.

In accordance with the invention, therefore, a doctor blade arrangement for controlling the thickness of the toner layer on a development roller in an electrophotographic apparatus is provided in a convenient and inexpensive manner in which no screws or mounting plates are required and uniformity of pressure of the toner thickness control end of the doctor blade against toner layer on the development roller is assured.

Although the invention has been described herein with respect to specific embodiments many modifications and variations therein will readily occur to those skilled in the art. Accordingly, all such variations and modifications are included within the intended scope of the invention.

We claim:

1. A doctor blade arrangement for an electrophotographic apparatus comprising:

a resilient sheet member having a mounting end with a bent portion and a projecting mounting lip and having a toner thickness control end for engaging a toner layer on the surface of a development member and controlling the thickness of the toner layer; and a mounting member formed with a groove having opposed surfaces to receive the mounting end of the resilient sheet member with opposing parts of the bent portion engaging the opposed surfaces of the groove, respectively, so as to be resiliently engaged therein and a projecting hook portion for receiving and holding the projecting mounting lip by resilient displacement of the projecting mounting lip so as to retain the resilient sheet member securely in position in the electrophotographic apparatus.

2. A doctor blade arrangement according to claim 1 wherein the bent portion of the mounting end of the resilient sheet member is bent in a continuous curve.

3. A doctor blade arrangement according to claim 1 wherein the toner thickness control end of resilient sheet member is thicker than an adjacent portion of the doctor blade.

4. A doctor blade arrangement for an electrophotographic apparatus comprising:

a resilient sheet member having a mounting end with a bent portion and a projecting mounting lip and having a toner thickness control end for engaging a toner layer on the surface of a development member and controlling the thickness of the toner layer; and a mounting member formed with a groove to receive the mounting end of the resilient sheet member and having a projecting hook portion for receiving and holding the projecting mounting lip by resilient displacement of the projecting mounting lip so as to retain the resilient sheet member securely in position in the electrophotographic apparatus;

wherein the bent portion of the mounting end includes a plurality parallel bends.

5. A doctor blade arrangement according to claim 4 wherein the projecting mounting lip extends substantially parallel to the plane of the toner thickness control end of the resilient sheet member.

6. A doctor blade arrangement according to claim 4 wherein the projecting mounting lip extends toward the plane of the toner thickness control end of the resilient sheet member.

7. A doctor blade arrangement according to claim 4 wherein the projecting mounting lip extends away from the plane of the toner thickness control end of the resilient sheet member.

8. A doctor blade arrangement according to claim 4 wherein the bent portion of the mounting end of the resilient sheet member includes at least three parallel bends.

9. A doctor blade arrangement according to claim 8 wherein the bent portion of the mounting end of the resilient sheet member includes four parallel bends.

* * * * *